US009398834B2

(12) United States Patent
Benedetti

(10) Patent No.: US 9,398,834 B2
(45) Date of Patent: Jul. 26, 2016

(54) SPINDLE AND HOLDER FOR A SPINDLE

(75) Inventor: Giovanni Benedetti, Wishaw (GB)

(73) Assignee: SCA HYGIENE PRODUCTS AB, Gothenburg (SE)

( * ) Notice: Subject to any disclaimer, the term of this patent is extended or adjusted under 35 U.S.C. 154(b) by 305 days.

(21) Appl. No.: 13/379,620

(22) PCT Filed: Jun. 30, 2009

(86) PCT No.: PCT/SE2009/050837

§ 371 (c)(1),
(2), (4) Date: Dec. 20, 2011

(87) PCT Pub. No.: WO2011/002360

PCT Pub. Date: Jan. 6, 2011

(65) Prior Publication Data

US 2012/0097789 A1 Apr. 26, 2012

(51) Int. Cl.

| | |
|---|---|
| ***B65H 75/24*** | (2006.01) |
| ***A47K 10/38*** | (2006.01) |
| *A47K 10/22* | (2006.01) |

(52) U.S. Cl.

CPC ..... *A47K 10/38* (2013.01); *B65H 75/245* (2013.01); *A47K 10/22* (2013.01)

(58) Field of Classification Search

USPC ..... 242/598, 598.3, 599, 599.4, 422.4, 609, 242/609.1, 612, 613

See application file for complete search history.

(56) References Cited

U.S. PATENT DOCUMENTS

| | | | | |
|---|---|---|---|---|
| 777,981 | A * | 12/1904 | Sterling | 242/571.5 |
| 2,073,429 | A * | 3/1937 | Spicher | 242/571.5 |
| 2,215,053 | A * | 9/1940 | Reese | 242/598.3 |
| 2,248,716 | A * | 7/1941 | Markle, Jr. | 242/571.5 |
| 2,370,821 | A * | 3/1945 | Stott | 242/422.4 |
| 2,419,798 | A * | 4/1947 | Stone | 242/571.5 |

(Continued)

FOREIGN PATENT DOCUMENTS

| | | |
|---|---|---|
| GB | 971057 A | 9/1964 |
| RU | 2172049 C1 | 8/2001 |

(Continued)

OTHER PUBLICATIONS

International Search Report (PCT/ISA/210) issued on Mar. 16, 2010, by Swedish Patent Office as the International Searching Authority for International Application No. PCT/SE2009/050837.

(Continued)

*Primary Examiner* — Emmanuel M Marcelo
*Assistant Examiner* — Justin Stefanon
(74) *Attorney, Agent, or Firm* — Buchanan Ingersoll & Rooney PC

(57) ABSTRACT

A spindle for mounting a roll of wiping material thereon. The spindle has a longitudinal extension and direction and includes a body and at least three elongated spring elements extending along the longitudinal direction. The body has a center section adapted to hold the roll, and each elongated spring element has a first end and a second end. The spindle is adapted to hold the roll and to be rotated about an essentially horizontal axis. The at least three elongated spring elements are arranged for stabilizing the roll on the center section. The first end and the second end of each spring element are fixedly attached to the body such that the spring elements are fixedly positioned in the longitudinal direction on the body. A holder for a roll of wiping material comprising such a spindle is also presented.

20 Claims, 5 Drawing Sheets

(56) References Cited

U.S. PATENT DOCUMENTS

| | | | | | |
|---|---|---|---|---|---|
| 2,562,923 | A | * | 8/1951 | Kolivoski | 242/571.5 |
| 2,851,227 | A | | 9/1958 | Bergelson | |
| 2,889,121 | A | * | 6/1959 | Heinle | 242/599.4 |
| 3,292,874 | A | * | 12/1966 | Tinkham | 242/571.5 |
| 3,386,673 | A | * | 6/1968 | Mader | 242/571.5 |
| 3,770,221 | A | * | 11/1973 | Stern | 242/422.4 |
| 4,071,200 | A | * | 1/1978 | Stone | 242/564 |
| 4,239,163 | A | | 12/1980 | Christian | |
| 4,447,015 | A | * | 5/1984 | Peterson | 242/599.1 |
| 4,738,385 | A | | 4/1988 | Bell | |
| 4,783,016 | A | * | 11/1988 | Pool | 242/571.4 |
| 4,878,631 | A | * | 11/1989 | Tanovici | 242/423.1 |
| 5,060,882 | A | * | 10/1991 | Rousculp et al. | 242/421.3 |
| 5,167,055 | A | | 12/1992 | Stoddart et al. | |
| 5,170,956 | A | * | 12/1992 | McTaggart | 242/422.4 |
| 5,297,750 | A | * | 3/1994 | Hunt | 242/422.4 |
| 5,374,007 | A | * | 12/1994 | Murison | 242/538.2 |
| 5,762,285 | A | * | 6/1998 | Lin | 242/565 |
| 5,775,707 | A | * | 7/1998 | Hu et al. | 280/11.223 |
| 6,241,180 | B1 | * | 6/2001 | Potter | 242/571.5 |
| 6,450,439 | B1 | | 9/2002 | Van Rees | |
| 6,628,789 | B1 | * | 9/2003 | Colby | 381/79 |
| 6,705,565 | B1 | * | 3/2004 | Newman et al. | 242/598.6 |
| 6,827,309 | B1 | * | 12/2004 | Velazquez et al. | 242/580 |
| 7,290,733 | B2 | * | 11/2007 | Kamenstein et al. | 242/598.2 |
| 7,306,185 | B1 | * | 12/2007 | Miller | 242/592 |
| 7,309,042 | B2 | * | 12/2007 | Rigas | 242/560.2 |
| 7,438,254 | B2 | * | 10/2008 | Oettershagen | 242/596.7 |

FOREIGN PATENT DOCUMENTS

| | | | |
|---|---|---|---|
| WO | WO 97/37918 | A1 | 10/1997 |
| WO | 98/49753 | A1 | 11/1998 |

OTHER PUBLICATIONS

Written Opinion (PCT/ISA/237) issued on Mar. 16, 2010, by Swedish Patent Office as the International Searching Authority for international Application No. PCT/SE2009/050837.

Office Action issue on Feb. 10, 2015, by the European Patent Office in corresponding European patent Application No. 09846906.7. (8 pages).

* cited by examiner

SPINDLE AND HOLDER FOR A SPINDLE

TECHNICAL FIELD

The disclosure relates to a spindle for supporting a roll of sheet material.

The disclosure also relates to a holder for holding a spindle of the above mentioned kind.

BACKGROUND OF THE INVENTION

A spindle and a holder is known from GB 971057, which in particular discloses a paper storage and dispensing device for use in a drawing office or at a packing station. The device includes a vertical casing, in which there is provided a hollow cylindrical drum with a cardboard tube with paper arranged thereon. A lower end of the cardboard tube with paper is supported by a drum journalled on a pinion. On the drum there are arranged a number of wires made from spring steel. The wires are at their ends inserted into holes in the drum.

The paper storage and dispensing device disclosed in GB 971057 is specifically designed for vertical use. Moreover, to allow the wires made from spring steel to yield when a tube with paper is to be mounted on the drum they are loosely fitted in the holes in the drum. This entails that the wires may adopt an incorrect position on the drum and even fall out of the holes. Mounting a tube on the drum may thus be awkward.

SUMMARY OF THE INVENTION

An object of the present invention is to provide a spindle for supporting a roll of wiping material where the roll is centred in a radial direction and securely held on the spindle for easy handling of the spindle and the roll when they are to be placed in a holder for the spindle or when they are removed therefrom.

According to an aspect of the invention, the object is achieved by a spindle for mounting a roll of sheet material thereon. The spindle has a longitudinal extension and direction and comprises a body and at least three elongated spring elements extending along the longitudinal direction. The body has a centre section adapted to hold the roll of sheet material, and each of the elongated spring elements has a first end and a second end. The spindle is adapted to hold a roll of wiping material and to be rotated about an essentially horizontal axis. The at least three elongated spring elements are arranged for stabilizing the roll of wiping material on the central section. Further, the first end and the second end of each of the elongated spring elements are fixedly attached to the body such that the elongated spring elements are fixedly positioned in the longitudinal direction on the body.

It is to be understood that the term sheet material means a material that is thin in comparison with its length and breadth. The term wiping material is to be interpreted in a broad sense, inter alia including paper, tissue and non-woven material suitable for wiping surfaces and objects.

Since the elongated spring elements are fixedly attached to the body they will stay in place when a roll of wiping material is being mounted on the spindle. The roll will be held onto the spindle such that handling of the spindle/roll unit is simple due to the elongated spring elements engaging the roll. Also, due to the fixed attachment of the first end and the second end, the elongated spring elements will not fold in a circumferential direction of the body. Accordingly, the roll will be centred in a radial direction on the body by means of the elongated spring elements.

As a result, the above mentioned object is achieved.

The spindle is adapted to be used for horizontally holding rolls of wiping material of a size larger than rolls of wiping paper for common household use, on a holder. Such holders may be used e.g. in large-scale kitchen, industrial or workshop environments and may weigh between 3-7 kg or more.

According to example embodiments the elongated spring element at its largest radial extension from the body may extend in a range of 5-10 mm in a radial direction from the spindle body when there is no roll of wiping material arranged on the spindle, the elongated spring element may at its largest radial extension from the body extends 0.2-4 mm in a radial direction from the spindle body when there is a roll of wiping material arranged on the spindle. In this manner it is ensured that the elongated spring elements engage the roll and center the roll on the spindle with a suitable force. The elongated spring elements may engage the roll such that a force of 5-35 Newton along the longitudinal direction is required to insert the spindle into, or remove the spindle from, the roll.

According to example embodiments the spindle may have a diameter in the range of 68-90 mm measured over the elongated spring elements when there is no roll of wiping material arranged on the spindle. Thus, the spindle may be suitable for mounting rolls with an inner diameter of a centre aperture of the roll in the range of 60-80 mm. this is an inner diameter common for rolls used in the above mentioned environments.

According to example embodiments the body of the spindle may be made from ABS plastic material and the elongated spring elements may be made from PA 6 GF30 plastic material. Accordingly, ABS lends itself for moulding the body of the spindle and will provide a spindle of suitable strength. PA 6 GF30 provides suitable strength and elastic properties in the elongated spring elements.

According to example embodiments the body of the spindle may be hollow. In this way material may be arranged where it provides most strength.

According to example embodiments each of the at least three elongated spring elements may have a lower rigidity in a radial direction than in a circumferential direction of the spindle. This may ensure a radial movement of the elongated spring elements when they are subjected to a load, i.e. when the spindle is inserted into a centre aperture of a roll of wiping material. Bending of the elongated spring elements in the circumferential direction of the spindle may thus be avoided and centering of the roll in a radial direction on the spindle is ensured.

According to example embodiments the body may comprise at least three ridges on each of which one of said at least three elongated spring elements is arranged. The body provided with ridges may increase the body stiffness in comparison with a round body. This may be of great advantage in particular, when the body of the spindle is made from a plastic material. The body may comprise four ridges on each of which one elongated spring element is arranged.

According to example embodiments the body on its outer side may be provided with a slot for each of the elongated spring elements, and wherein each of the elongated spring elements is at least partially arranged in the slot to be supported by the body in a circumferential direction of the spindle. For instance the first end and the second end of the elongated spring elements may be arranged inside the slot such that the elongated spring elements at these ends are essentially flush with the outer surface of the body and in-between the first end and the second end the elongated spring element may gradually extend out of the slot. A lateral support of the elongated spring elements may thus be provided. Again, this may ensure a radial movement of the elongated spring elements when they are subjected to a load, i.e. when the spindle is inserted into a roll of wiping material. Bending of the elongated spring elements in the circumferential direction of the spindle may thus be avoided and centering of the roll on the spindle is ensured.

According to example embodiments the at least three elongated spring elements may be snap-fitted to the body. Suitably the first end and the second end of each elongated spring element may be provided with resilient members adapted to fit holes in the body of the spindle. Retaining end portions of the members may engage with edge portions of the holes. An easy mounting of the elongated spring elements to the body may thus be ensured. Also, support of the elongated spring elements in the circumferential direction may be supported by snap-fit connections.

According to example embodiments the body may comprise at least two body parts forming the body. The at least two body parts are fitted together. In this manner the body may easily be formed. In particular, casting the body from plastic material may be facilitated. The at least two body parts may be identical. This may greatly facilitate manufacturing of the body of the spindle. Casting the identical body parts in one mould may greatly reduce production costs. The at least two body parts may be snap-fit together. This may provide easily assembled spindle bodies.

According to example embodiments the body may have two bearing surfaces, one at each end of the body outside the centre section. Providing a bearing surface on the body may facilitate the construction of a holder adapted to carry the spindle with a roll of wiping material mounted thereon.

According to example embodiments the body at each of its two outer ends may be provided with a handle. Providing a dedicated handle may improve handling of the spindle, in particular when a heavy roll of wiping material is to be mounted in a holder. No grasping around the roll or at bearing surfaces is required. The handles may have a smaller diameter than the spindle at its centre section.

According to a further aspect of the invention there is provided a holder for a roll of wiping material comprising a spindle according to aspects of example embodiments referred to above, and wherein the spindle is arranged essentially horizontally in the holder.

According to example embodiments the holder may comprise two bearing seats, one at each end of the spindle, arranged to hold the bearing surfaces of the body of the spindle.

According to example embodiments the holder may be adapted to hold the spindle with the handles accessible outside the bearing seats.

According to example embodiments the holder may be a stand-alone unit and comprise a leg arrangement. Alternatively, the holder may be a wall mounted unit and comprise at least one wall mounting connection.

Further features of, and advantages with, the present invention will become apparent when studying the appended claims and the following description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein.

Disclosed features of example embodiments may be combined as readily understood by one of ordinary skill in the art to which this invention belongs. Like numbers refer to like elements throughout.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present.

Well-known functions or constructions may not be described in detail for brevity and/or clarity.

Figure 1:
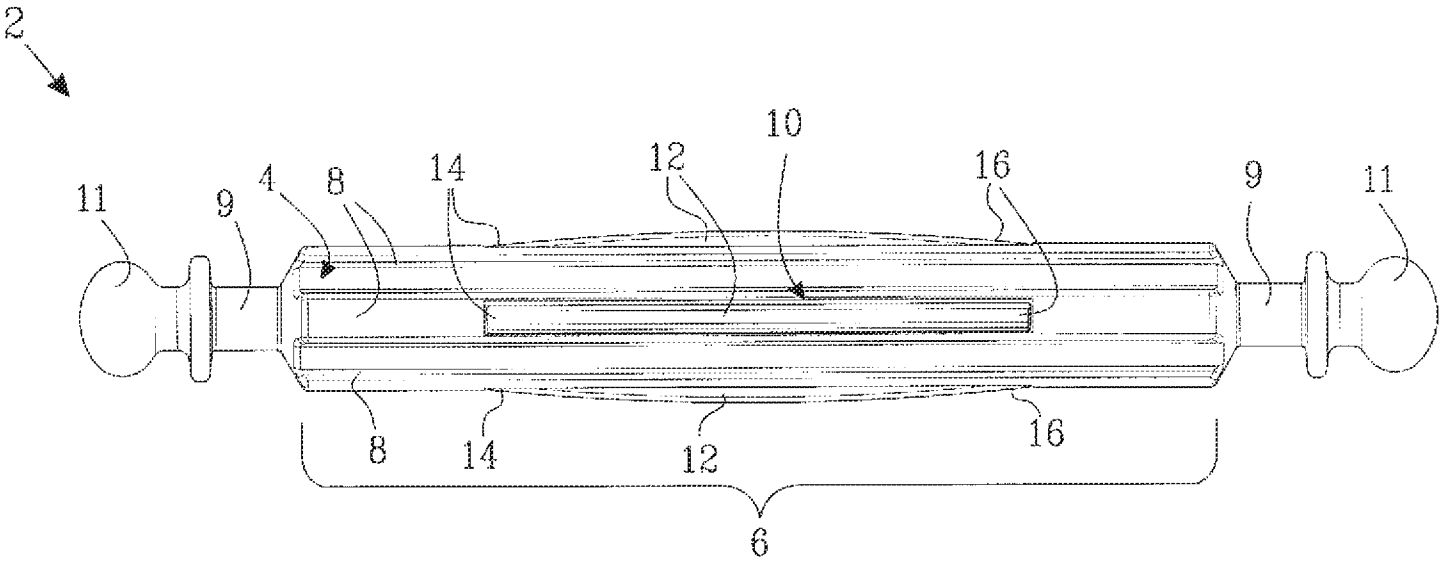
FIGS. 1 and 2 illustrate schematically a spindle for a roll of wiping material according to example embodiments.

FIG. 1 illustrates schematically a spindle 2 for a roll of wiping material according to example embodiments. The spindle 2 comprises a body 4. The body 4 has a centre section 6 adapted for mounting a roll of wiping material thereon. The body 4 is provided with four ridges 8, three of which are visible in FIG. 1. Each ridge 8 is provided with a slot 10, in which elongated spring elements 12 are arranged and fixedly attached to the body 4. The elongated spring elements 12 have resilient properties and are attached to the body 4 such that they are fixed at a respective first end 14 and second end 16 of each elongated spring element 12 and such that they may move in a radial direction of the spindle 2 between the first and second ends 14, 16. The resilient properties ensure that a roll of wiping material can be held on the spindle 2 in a stable manner. The fixed attachment in the slot ensures that the elongated spring elements do not fold in a circumferential direction of the spindle 2 and thus the roll of wiping material is centred in a radial direction on the spindle 2. Also, this makes possible handling of the spindle 2 in a horizontal orientation without the elongated spring elements falling out of place.

The spindle 2 comprises two bearing surfaces 9, one at each end of the spindle 2, which are adapted to bear against, and rotate in, bearing seats of a holder for the spindle 2 with a roll of wiping material mounted thereon. At each outer end, the spindle 2 comprises a handle 11. By means of these handles 11 the spindle 2 may be lifted in and out of a holder. In particular this facilitates mounting large rolls of wiping material in holders adapted therefore. Such rolls may weigh between 3 and 7 kg, sometimes even more. The two handles 11 also make handling the spindle 2 and a mounted roll with two hands in a horizontal position the most natural choice.

The body 4 may be made from a plastic material such as ABS, which will provide an adequate strength-to-weight ratio. The elongated spring elements 12 may advantageously be manufactured from a plastic material, e.g. PA 6 GF30, which provides suitable strength and elastic properties. A particular advantage of the use of plastic material instead of spring steel in the elongated spring elements (as disclosed in GB 971057) is that the plastic material provides elastic properties such that the elongated spring element 12 will deform also with its first and second ends 14, 16 fixed. This is in sharp contrast with spring steel, which must be movably attached to the body of the spindle to allow sufficient deformation and displacement of the elongated spring element to not damage the core of a roll to be mounted on the spindle.

Figure 2:
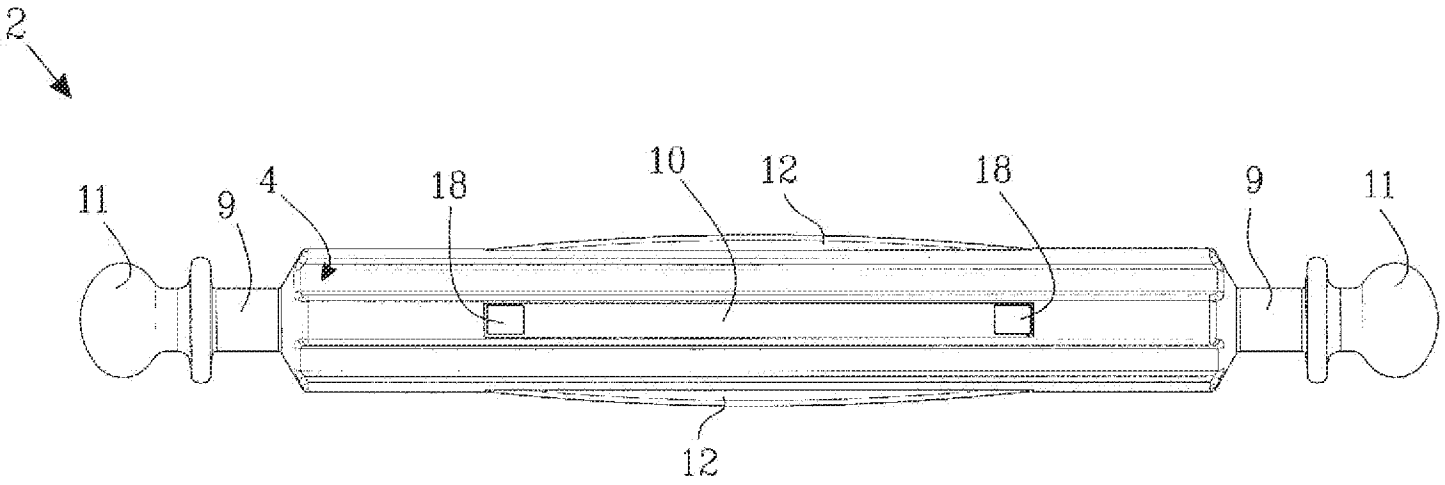

FIG. 2 illustrates schematically the spindle 2 for a roll of wiping material according to example embodiments with one of the elongated spring elements 12 removed to more closely show one slot 10, in which one spring element 12 is to be arranged. As mentioned above the slot 10 is provided in a ridge 8 of the body 4. At each end of the slot 10 there is provided an opening 18 which is adapted to receive part of the first end 14 and part of the second end 16 of one elongated spring element 12.

Figure 3:
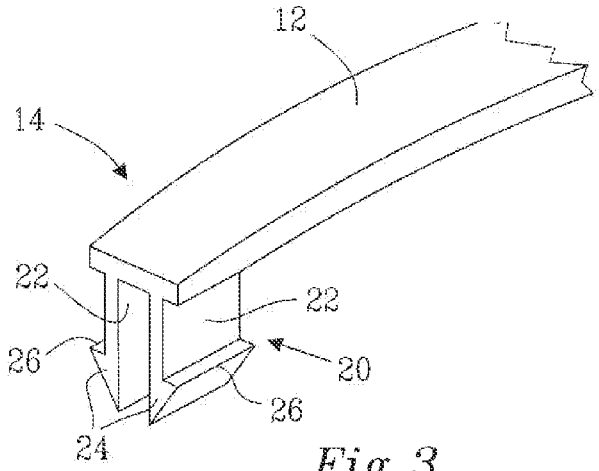
FIG. 3 illustrates schematically a portion of an elongated spring element for a spindle according to example embodiments.

FIG. 3 illustrates schematically a portion of an elongated spring element 12 for a spindle according to example embodiments. A first end 14 of the elongated spring element 12 is provided with an attachment arrangement 20 adapted to be snap-fitted onto a body of a spindle. A second, non-shown end of the elongated spring element 12 may be provided with a similar attachment arrangement. The attachment arrangement 20 comprises two resilient members 22, each being provided with a pointed retaining portion 24. Each retaining portion 24 has a lip 26 adapted to engage with an edge portion of an aperture or an opening.

For instance, the attachment arrangement 20 may be adapted to fit into an opening 18 at a bottom of the slot 10 in the body 4 of a spindle 2 as illustrated in FIG. 2.

Accordingly, the following procedure may be followed when the elongated spring element 12 illustrated in FIG. 3 is snap-fitted to the body 4 illustrated in FIG. 2:

- The elongated spring element 12 is inserted into the slot 10.
- Each of the first end 14 and the second end 16 is pressed with a force towards a centre of the spindle 2.
- In doing so the resilient members 22 are bent towards each other by outer sides of the pointed retaining portions 24 being pressed into the openings 18.
- When the pointed retaining portions 24 have passed through the openings 18, the resilient members 22 spring outwardly and the lips 26 engage with edge portions of the openings 18.

Figure 4:
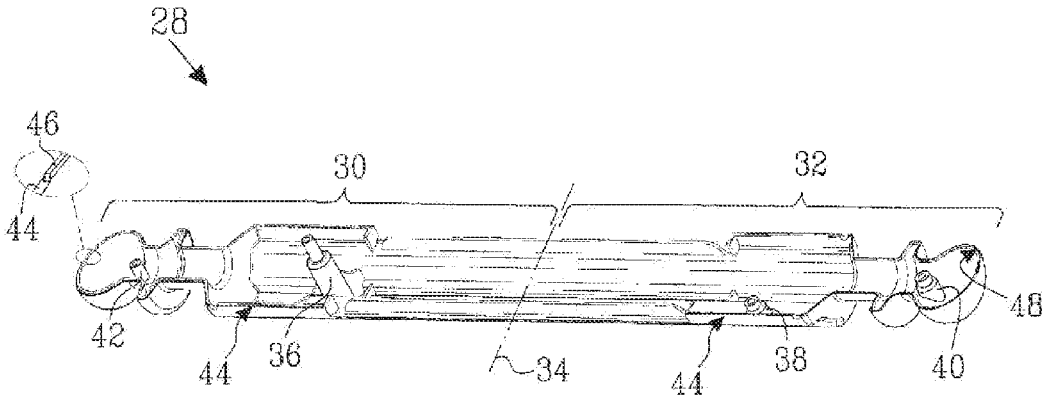
FIG. 4 illustrates schematically a body part of a spindle body according to example embodiments.

FIG. 4 illustrates schematically a body part of a spindle body according to example embodiments. A body of a spindle may comprise two or more separate body parts. In this example two identical body parts in the form of two body halves are joined to form a spindle. A body half 28 consists of a first part 30 and a second part 32 on each side of a middle line 34. On a side of the body half 28 forming part of the exterior surface of the spindle body (facing mainly downwards in FIG. 4), the first part 30 and the second part 32 are essentially identical. On a side of the body half 28 forming part of the interior of the spindle body, the first and second parts 30, 32 are different. Due to this design, two identical body halves 28 may be joined to form one spindle body.

The first parts 30 of two body halves 28 each comprise a first bolt holding stud 36, in each of which a bolt may be arranged to be screwed into a first bolt receiving stud 38 being arranged on each of the second parts 32 of the two body halves 28. Similarly, the second parts 32 each comprise a second bolt holding stud 40, in which a bolt may be arranged to be screwed in to a second bolt receiving stud 42 being arranged in each of the first parts 30 of the two body halves 28. To further improve joining of the two body halves 28, the first part 30 of each body half 28 may, at least partly, at an inner side of an edge 44 of the body half 28 be provided with a bead 46. The bead 46 fits into a recess 48 provided along a corresponding portion of the edge 44 at the second part 32.

Other methods of joining two or more spindle body parts than using bolts may include e.g. riveting, gluing, welding or body parts being snap-fit together.

Figure 5:
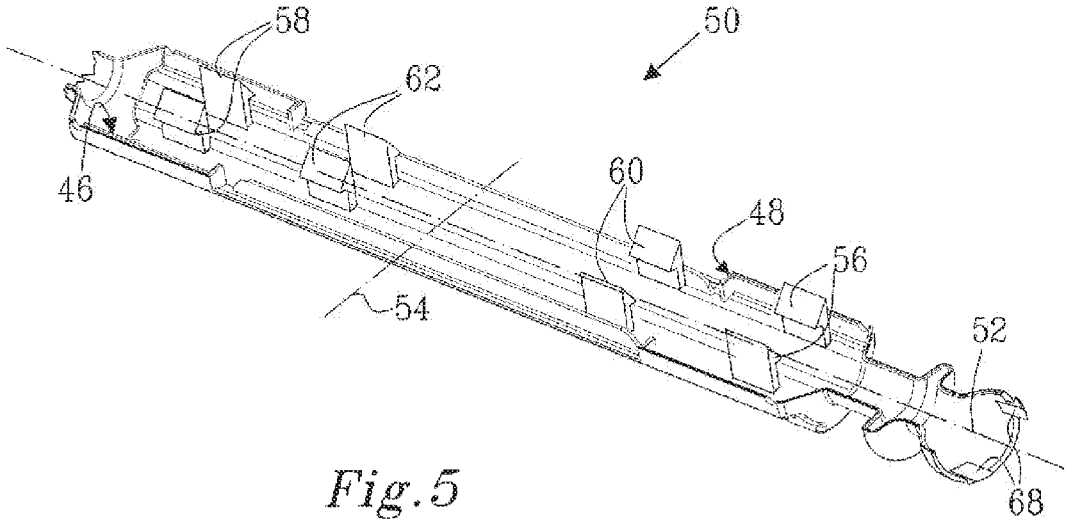
FIGS. 5 and 6 illustrate schematically body parts of a spindle body for a roll of wiping material according to example embodiments.
Figure 6:
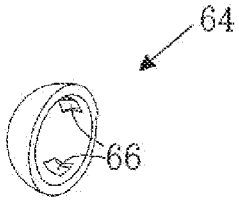

FIGS. 5 and 6 illustrate schematically body parts of a spindle body for a roll of wiping material according to example embodiments. In this example the body of a spindle comprises four separate parts, two identical first body parts 50 and two identical second body parts 64. The first body part 50 is provided with a number of snap-fit connectors 56, 58, 60, 62, 68 each comprising a resilient member, a pointed retaining portion and a lip as described above with reference to FIG. 3 and the elongated spring element 12. The snap-fit connectors 56, 58, 60, 62, 68 are adapted to engage with either a dedicated edge portion of a joining body part or with another snap-fit connector of a joining body part as will be explained below.

The first body part 50 is adapted to be joined with an identical first body part 50 rotated 180 degrees about a centre axis 52 of the spindle body and 180 degrees about a second axis 54, perpendicular to the centre axis 52. (That is, to be joined to each other the two first body parts are positioned in relation to each other like the two body halves 28 mentioned above with reference to FIG. 4.) Thus, first snap-fit connectors 56 of the two first body parts 50 are engaged with second snap-fit connectors 58 of the two first body parts 50, and third snap-fit connectors 60 of the two first body parts 50 are engaged with fourth snap-fit connectors 62 of the two first body parts 50. It is noted that the first and third snap-fit connectors 56, 60 are arranged with their lips directed towards the interior of the spindle body and the second and fourth snap-fit connectors 58, 62 are arranged with their lips directed towards an outside of the spindle body thus, making engagement between the snap-fit connectors 56, 58, 60, 62 possible. As mentioned above with reference to FIG. 4, to further improve joining of the two first body parts 50, a part of an inner side of an edge of the first body parts may be provided with a bead 46 and a different part the edge of the first body parts may be provided with a recess 48.

Turning to FIG. 6, the second body part 64 forms an end cap of the spindle body to be engaged with two joined first body parts 50. For this purpose the second body part 64 is provided with four recesses 66 (two of which are shown in FIG. 6) on its inner surface. Edges of the recesses 66 are adapted to engage with fifth snap-fit connectors 68 arranged at each end of the first body parts 50 (only shown at one end of the first body part in FIG. 5).

By pressing one second body part 64 to each end of a pair of joined first body parts 50 the resulting spindle body is provided with end caps and the spindle body is securely held together.

Figure 7:
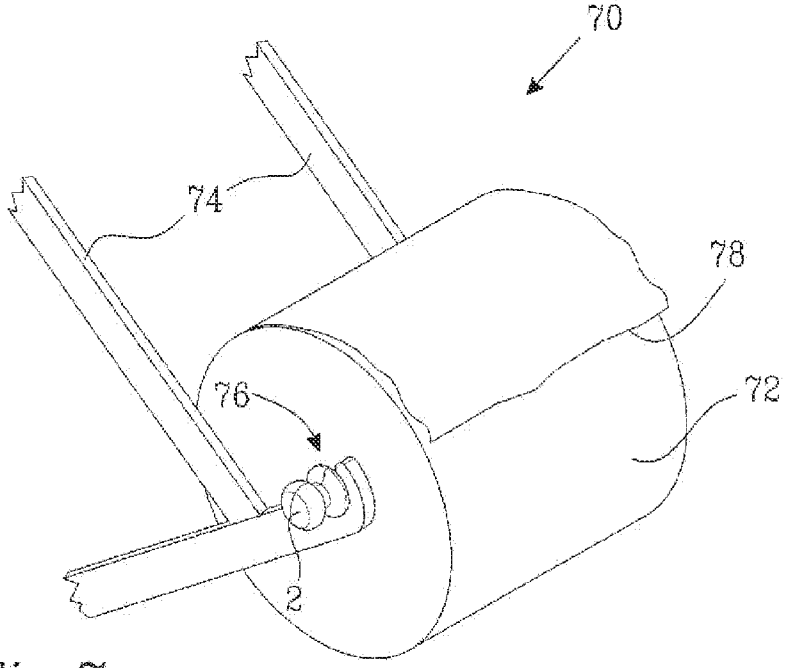
FIG. 7 illustrates schematically a wall mounted holder according to example embodiments.

FIG. 7 illustrates schematically a wall mounted holder 70 according to example embodiments for a roll 72 of wiping material. The holder 70 comprises two brackets 74 forming mounting connections, which may be fastened to a wall or similar structure. The roll 72 is mounted horizontally on the holder 70 by means of a spindle 2 in accordance with described example embodiments is mounted horizontally. Each bracket 74 is provided with a bearing seat 76, on which the bearing surfaces 9 (see FIG. 1) of the spindle 2 rest and rotate.

Figure 8:
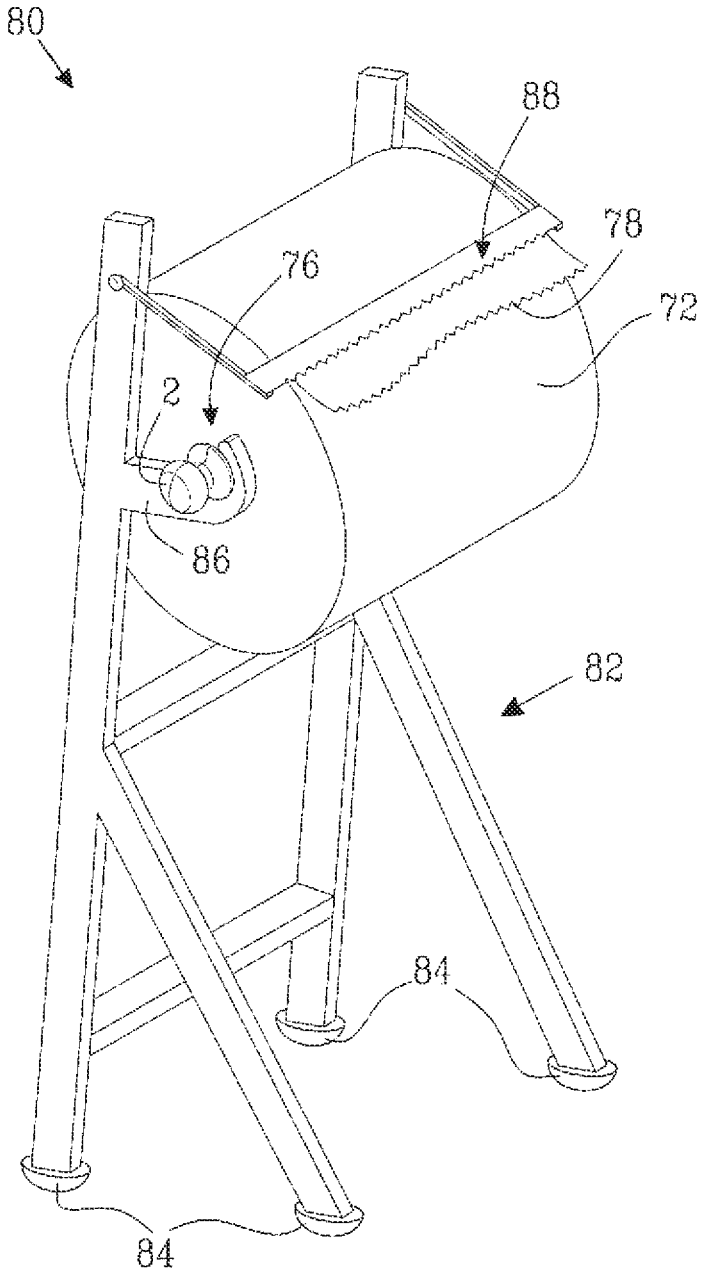
FIG. 8 illustrates schematically a stand-alone holder according to example embodiments.

FIG. 8 illustrates schematically a stand-alone holder 80 according to example embodiments for a roll 72 of wiping material. The holder 80 comprises a leg arrangement 82, the lower end of which is provided with feet 84 and/or wheels and the upper end of which is provided with two arms 86 (one of which is shown in FIG. 8). On the two arms 86 a spindle 2 in accordance with described example embodiments is mounted horizontally. Each arm 86 is provided with a bearing seat 76, on which the bearing surfaces 9 (see FIG. 1) of the spindle 2 rest and rotate.

In use of the holders 70, 80 illustrated in FIGS. 7 and 8, a user grasps an end 78 of the sheet of wiping material on the roll 72, unwinds a desired amount of wiping material and then tears off the unwound piece of wiping material. As the roll 72 rotates during unwinding of the wiping material, the spindle 2 also rotates in the holder 70 on the bearing seats 76 due to the elongated spring elements 12 of the spindle 2 engaging and stabilizing the roll 72 on the spindle 2. Also due to the elongated spring elements 12 stabilizing the roll 72 on the spindle 2, the roll 72 rotates smoothly without vibrating or rattling. For the purpose of facilitating tearing off wiping material there may be provided a straight or serrated edge 88 as shown in FIG. 8.

When the roll 72 of wiping material has been consumed the spindle 2 is lifted from the relevant holder 70, 80 and, if applicable, the empty core of the consumed roll is withdrawn from the spindle 2. This may require a force between 15 and 35 Newton due to the elongated spring elements 12 engaging the core. The spindle 2 is inserted into a centre aperture of a new roll 72 of wiping material. (This may be a roll provided with a separate core, e.g. in the form of a cardboard tube, or a roll where the centre aperture is formed by surrounding wiping material.) Inserting the spindle into the centre of the new roll may again require a force between 15 and 35 Newton due to the elongated spring elements 12 engaging the roll. The spindle 2 with the newly mounted roll is lifted back onto the holder 70, 80 and its bearing seats 76 by the user holding at the handles 11 provided at the ends of the spindle 2.

Example embodiments may be combined as understood by a person skilled in the art, and even though the invention has been described with reference to example embodiments, many different alterations, modifications and the like will become apparent for those skilled in the art. The spindle may be provided with a different number of spring elements than three or four, e.g. six or eight. Body parts of a spindle may also be fitted together with a combination of the described connectors and mentioned methods.

Therefore, it is to be understood that the foregoing is illustrative of various example embodiments and is not to be limited to the specific embodiments disclosed and that modifications to the disclosed embodiments, combinations of features of disclosed embodiments as well as other embodiments are intended to be included within the scope of the appended claims.

The invention claimed is:

1. A spindle for supporting a roll of sheet material thereon, said spindle having a longitudinal extension and direction and comprising a body and at least three elongated spring elements extending along said longitudinal direction, said body having a centre section adapted to hold said roll of sheet material, and each said elongated spring element having a first end and a second end, wherein said spindle is adapted to hold said roll of sheet material and to be rotated about an axis and said at least three elongated spring elements are arranged for stabilizing said roll of sheet material on said centre section, and said first end and said second end of each of said spring elements are attached to said body such that said spring elements are positioned in said longitudinal direction on said body, wherein said body on its outer side is provided with a respective slot for each of said elongated spring elements, wherein each slot comprises:

a first opening at said first end of a respective one of the elongated spring elements;

a second opening at said second end of said respective one of the elongated spring elements; and a slot bottom wall and slot side walls between the first opening and the second opening, wherein each of said elongated spring elements is at least partially arranged in said slot to be supported by said slot side walls in a circumferential direction of said spindle.

2. The spindle according to claim 1, wherein each of said elongated spring elements at its largest radial extension from said body of said spindle extends 5-10 mm in a radial direction from said body when there is no roll of sheet material arranged on said spindle.

3. The spindle according to claim 1, wherein said spindle has a diameter in the range of 68-90 mm measured over said elongated spring elements when there is no roll of sheet material arranged on said spindle.

4. The spindle according to claim 1, wherein said body is made from ABS plastic material and said elongated spring elements are made from PA 6 GF30 plastic material.

5. The spindle according to claim 1, wherein each of said at least three elongated spring elements has a lower rigidity in a radial direction than in a circumferential direction of said spindle.

6. The spindle according to claim 1, wherein said body comprises at least three ridges on each of which one of said at least three elongated spring elements is arranged.

7. The spindle according to claim 1, wherein said at least three elongated spring elements are snap-fitted to said body at the first and second opening.

8. The spindle according to claim 1, wherein said body is hollow and comprises at least two body parts forming said body, said at least two body parts being snap-fitted together.

9. The spindle according to claim 8, wherein said at least two body parts are identical.

10. A holder for a roll of sheet material comprising a spindle according to claim 1, wherein said spindle comprises two bearing surfaces, one at each end of said body outside said centre section, and wherein said holder comprises two bearing seats arranged to hold said bearing surfaces such that said spindle is arranged essentially horizontally in said holder.

11. The holder according to claim 10, the spindle further comprising handles, wherein said holder is adapted to hold said spindle with said handles accessible outside said bearing seats.

12. The holder according to claim 10, wherein said holder is a stand-alone unit and comprises a leg arrangement.

13. The holder according to claim 10, wherein said holder is wall mounted unit and comprises at least one wall mounting connection.

14. The holder according to claim 10, wherein said elongated spring element at its largest radial extension from said body extends 0.2-4 mm in a radial direction from said body when there is a roll of sheet material arranged on said spindle.

15. A spindle for supporting a roll of sheet material thereon, said spindle having a longitudinal extension and direction and comprising a body and at least three elongated spring elements extending along said longitudinal direction, said body having a centre section adapted to hold said roll of sheet material, and each said elongated spring element having a first end and a second end, wherein said spindle is adapted to hold said roll of sheet material and to be rotated about an axis and said at least three elongated spring elements are arranged for stabilizing said roll of sheet material on said centre section, and said first end and said second end of each of said spring elements are attached to said body such that said spring elements are positioned in said longitudinal direction on said body, wherein each of said at least three elongated spring elements supports first and second attachment arrangements, each attachment arrangement comprising two resilient members and configured to be snap-fitted into said body, each resilient member including a respective prong to be snap-fitted into said body.

16. The spindle according to claim 15, wherein each attachment arrangement of each of said at least three elongated spring elements is snap-fitted into a corresponding opening of the body.

17. The spindle according to claim 15, wherein each attachment arrangement is configured such that when a respective end of a respective one of the elongated spring elements is pressed with a force toward a center of the spindle, said two resilient members bend towards each other, and when the respective end of the respective one of the elongated spring elements is further pressed with the force toward the center of the spindle, said two resilient members spring away from each other to engage with a respective opening of the body.

18. A spindle for supporting a roll of sheet material thereon, said spindle having a longitudinal extension and direction and comprising a body and at least three elongated spring elements extending along said longitudinal direction, said body having a centre section adapted to hold said roll of sheet material, and each said elongated spring element having a first end and a second end, wherein said spindle is adapted to hold said roll of sheet material and to be rotated about an axis and said at least three elongated spring elements are arranged for stabilizing said roll of sheet material on said centre section, and said first end and said second end of each of said spring elements are attached to said body such that said spring elements are positioned in said longitudinal direction on said body, wherein each of said at least three elongated spring elements supports first and second attachment arrangements, each attachment arrangement comprising two resilient members and configured to be snap-fitted into said body, wherein said body on its outer side is provided with a respective slot for each of said elongated spring elements, wherein each slot comprises:

a first opening at said first end of a respective one of the elongated spring elements;

a second opening at said second end of said respective one of the elongated spring elements; and a slot bottom wall and slot side walls between the first opening and the second opening, wherein each of said elongated spring elements is at least partially arranged in said slot to be supported by said slot side walls in a circumferential direction of said spindle.

19. A spindle for supporting a roll of sheet material thereon, said spindle having a longitudinal extension and direction and comprising a body and at least three elongated spring elements extending along said longitudinal direction, said body having a centre section adapted to hold said roll of sheet material, and each said elongated spring element having a first end and a second end, wherein said spindle is adapted to hold said roll of sheet material and to be rotated about an axis and said at least three elongated spring elements are arranged for stabilizing said roll of sheet material on said centre section, and said first end and said second end of each of said spring elements are attached to said body such that said spring elements are positioned in said longitudinal direction on said body, wherein each of said at least three elongated spring elements supports first and second attachment arrangements, each attachment arrangement comprising two resilient members and configured to be snap-fitted into said body, the resilient members of the each of said at least three elongated spring elements being parallel to one another.

20. A spindle for supporting a roll of sheet material thereon, said spindle having a longitudinal extension and direction and comprising a body and at least three elongated spring elements extending along said longitudinal direction, said body having a centre section adapted to hold said roll of sheet material, and each said elongated spring element having a first end and a second end, wherein said spindle is adapted to hold said roll of sheet material and to be rotated about an axis and said at least three elongated spring elements are arranged for stabilizing said roll of sheet material on said centre section, and said first end and said second end of each of said spring elements are attached to said body such that said spring elements are positioned in said longitudinal direction on said body, wherein each of said at least three elongated spring elements supports first and second attachment arrangements, each attachment arrangement comprising two resilient members and configured to be snap-fitted into said body, each resilient member extending from a respective elongated spring element in a perpendicular direction relative to a central axis of the spindle.

* * * * *